US008141864B2

(12) United States Patent
Fukumoto et al.

(10) Patent No.: US 8,141,864 B2
(45) Date of Patent: Mar. 27, 2012

(54) RECORDING-MEDIUM FEEDING DEVICE

(75) Inventors: Takashi Fukumoto, Miyagi (JP); Munehisa Fuda, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 421 days.

(21) Appl. No.: 12/153,695

(22) Filed: May 22, 2008

(65) Prior Publication Data

US 2008/0297580 A1 Dec. 4, 2008

(30) Foreign Application Priority Data

| | | |
|---|---|---|
| May 28, 2007 | (JP) | 2007-141019 |
| Sep. 4, 2007 | (JP) | 2007-228546 |
| Sep. 4, 2007 | (JP) | 2007-228547 |
| Sep. 4, 2007 | (JP) | 2007-228548 |
| Jan. 22, 2008 | (JP) | 2008-012053 |
| Jan. 22, 2008 | (JP) | 2008-012054 |

(51) Int. Cl.
*B65H 3/14* (2006.01)

(52) U.S. Cl. ..... 271/97; 271/98

(58) Field of Classification Search ..... 271/97, 271/98

See application file for complete search history.

(56) References Cited

U.S. PATENT DOCUMENTS

| | | | | |
|---|---|---|---|---|
| 5,876,030 | A | 3/1999 | Dobbertin et al. | |
| 6,431,538 | B1 * | 8/2002 | La Vos et al. | 271/98 |
| 7,677,553 | B2 * | 3/2010 | Ikeda | 271/98 |
| 7,744,080 | B2 * | 6/2010 | Shimoohsako | 271/97 |
| 2001/0017441 | A1 | 8/2001 | Yamaguchi et al. | |
| 2004/0178557 | A1 * | 9/2004 | Okazaki et al. | 271/97 |

FOREIGN PATENT DOCUMENTS

| | | |
|---|---|---|
| EP | 1 090 859 | 4/2001 |
| JP | 10-194491 | 7/1998 |
| JP | 10-194493 | 7/1998 |
| JP | 10-218405 | 8/1998 |
| JP | 10-316263 | 12/1998 |
| JP | 11-157678 | 6/1999 |
| JP | 2001-019187 | 1/2001 |
| JP | 2001-088964 | 4/2001 |
| JP | 2001-354331 | 12/2001 |
| JP | 3272408 | 1/2002 |
| JP | 2002-046884 | 2/2002 |
| JP | 2002-104679 | 4/2002 |
| JP | 3482630 | 10/2003 |
| JP | 2004-010360 | 1/2004 |
| JP | 2004-067321 | 3/2004 |
| JP | 3550263 | 4/2004 |

(Continued)

OTHER PUBLICATIONS

Abstract of JP 10-120213 published May 12, 1998.

(Continued)

*Primary Examiner* — Kaitlin Joerger

(74) *Attorney, Agent, or Firm* — Harness, Dickey & Pierce, P.L.C.

(57) ABSTRACT

A recording-medium feeding device feeds a recording medium by separating loaded recording media sheet by sheet. An air outlet blows air to the recording media from a lateral side with respect to a direction of feeding the recording-medium. The air outlet is formed cross a recording-medium feeding plane, such that an upper edge in an upstream of the recording-medium feeding direction is higher than an upper edge in a downstream of the recording-medium feeding direction.

13 Claims, 14 Drawing Sheets

FOREIGN PATENT DOCUMENTS

| | | |
|---|---|---|
| JP | 2004-284781 | 10/2004 |
| JP | 2004-284782 | 10/2004 |
| JP | 2004-284783 | 10/2004 |
| JP | 2004-331358 | 11/2004 |
| JP | 3710255 | 8/2005 |
| JP | 3739567 | 11/2005 |
| JP | 2006-027796 | 2/2006 |
| JP | 2006-248673 | 9/2006 |
| JP | 2006-321629 | 11/2006 |
| JP | 2007-008656 | 1/2007 |

OTHER PUBLICATIONS

Abstract of JP 10-338361 published Dec. 22, 1998.

Abstract of JP 11-059966 published Mar. 2, 1999.

Abstract of JP 11-292301 published Oct. 26, 1999.

Abstract of JP 06-080305 published Mar. 22, 1994.

Extended European Search Report for corresponding European patent application No. 08 251 843.2 dated Dec. 17, 2010.

* cited by examiner

RECORDING-MEDIUM FEEDING DEVICE

CROSS-REFERENCE TO RELATED APPLICATIONS

The present application claims priority to and incorporates by reference the entire contents of Japanese priority documents, 2007-141019 filed in Japan on May 28, 2007, 2007-228546 filed in Japan on Sep. 4, 2007, 2007-228547 filed in Japan on Sep. 4, 2007 and 2007-228548 filed in Japan on Sep. 4, 2007, 2008-012053 filed in Japan on Jan. 22, 2008 and 2008-012054 filed in Japan on Jan. 22, 2008.

BACKGROUND OF THE INVENTION

1. Field of the Invention

The present invention relates to a recording-medium feeding device for an image forming apparatus, such as a photocopier, a printer, or a facsimile, to facilitate feeding a recording medium.

2. Description of the Related Art

Conventionally, a paper feeding device that feeds paper to an image forming unit or a printing unit from a bundle of paper loaded in a paper loading unit by separating the paper sheet by sheet by blowing air to the paper from an air outlet has been known for an image forming apparatus, such as a photocopier, and a printer. Particularly, a configuration that a nozzle opening is arranged on a part of a side fence below a passage of paper fed from a paper tray, and a pair of such nozzle openings are symmetrically arranged on a pair of side fences that are arranged opposingly to each other is known (see, for example, Japanese Patent Application Laid-open No. 2007-008656).

Another paper feeding device that includes a guide to restrict floating of paper when separating and feeding paper by blowing air is known (see, for example, Japanese Patent Application Laid-open No. 2006-321629).

As shown in FIG. 21A, Japanese Patent Application Laid-open No. 2007-008656 discloses a paper feeding device that includes an air outlet 601 that blows air, a paper feeding roller 603 that fees paper, and a paper-feeding plane P. The air outlet 601 is arranged vertically below the paper-feeding plane P. The air outlet 601 is configured to blow air from a lateral side of a paper feeding direction indicated by an arrow D when feeding paper, and to separate a top sheet of paper from the following sheet. However, according to Japanese Patent Application Laid-open No. 2007-008656, a vertical height of the air outlet 601 is insufficient, consequently, paper cannot be kept floating.

Japanese Patent Application Laid-open No. 2006-321629 discloses another paper feeding device that includes the air outlet 601, the paper feeding roller 603, and the paper-feeding plane P as shown in FIG. 21B. The air outlet 601 further includes an upper end guide 605. The air outlet 601 is formed to straddle the paper-feeding plane P vertically. However, despite that the air outlet 601 includes the upper end guide 605, a top sheet of paper tends to float too high. For this reason, according to Japanese Patent Application Laid-open No. 2006-321629, the paper cannot be fed with an appropriate angle to the paper feeding roller 603.

Paper feeding devices are often configured to use paper other than plain paper, such as coated paper, art paper, films, and the like, because of recent diversification of variations of paper. Particularly when using paper other than plain paper, the conventional paper feeding devices cannot feed paper appropriately to an image forming unit due to two problems described above. Consequently, there is a possibility that faulty paper feeding by the paper feeding device gives an adverse effect on forming image.

According to the above paper feeding devices, no inventive idea about a shape of the air outlet is described, and the shape of the air outlet is not taken into account.

To feed paper at an appropriate angle means to keep an angle of a sheet of paper to be appropriate to a paper feeding roller or a reverse roller of the paper tray in the description herein. The paper-feeding plane P means a plane P in the horizontal direction in contact with the bottom of the paper feeding roller 603.

SUMMARY OF THE INVENTION

It is an object of the present invention to at least partially solve the problems in the conventional technology.

According to an aspect of the present invention, there is provided a recording medium feeding device that feeds a recording medium by separating loaded recording media sheet by sheet. The recording medium feeding device includes an air outlet that blows air to the recording media from a lateral side with respect to a direction of feeding the recording-medium, the air outlet being formed cross a recording-medium feeding plane. The air outlet is formed such that an upper edge in an upstream of the recording-medium feeding direction is higher than an upper edge in a downstream of the recording-medium feeding direction.

Furthermore, according to another aspect of the present invention, there is provided a recording medium feeding device that feeds a recording medium by separating loaded recording media sheet by sheet. The recording medium feeding device includes an air outlet that blows air to the recording media from a lateral side with respect to a direction of feeding the recording-medium, the air outlet being formed cross a recording-medium feeding plane. The air outlet is formed such that a lower edge in an upstream of the recording-medium feeding direction is higher than a lower edge in a downstream of the recording-medium feeding direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
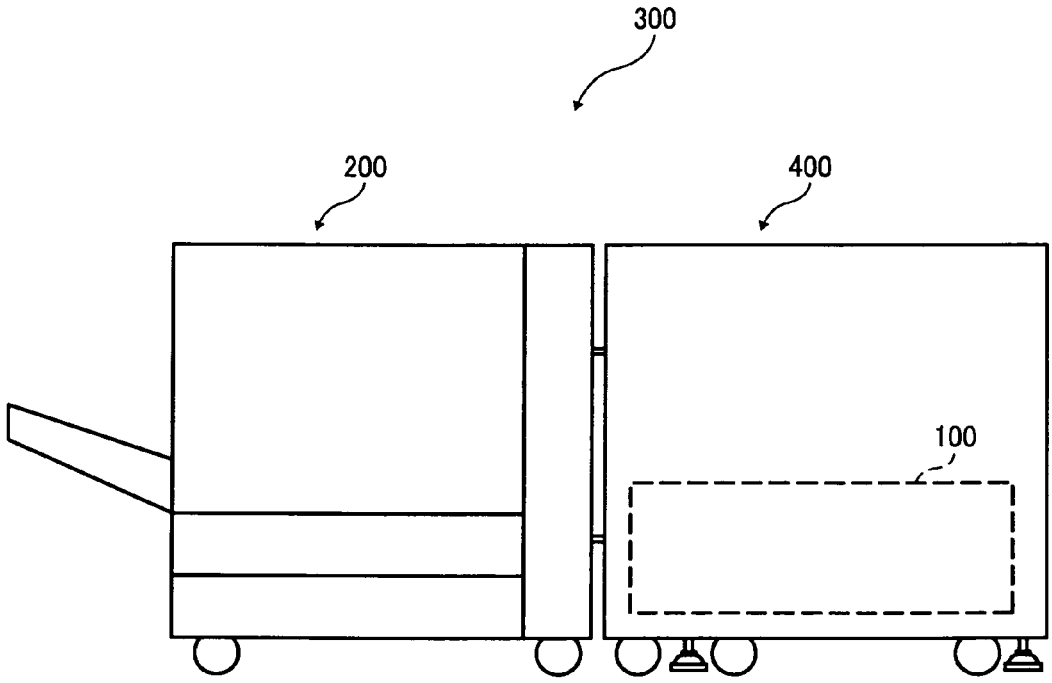
FIG. 1 is a schematic diagram for explaining a general configuration of a printer according to an embodiment of the present invention.

Exemplary embodiments of the present invention will be explained below in detail with reference to the accompanying drawings.

The same parts or corresponding parts are assigned with the same reference numerals in the drawings, and repetition of some of explanations will be simplified or omitted appropriately.

Configurations of a large capacity tray 400 and a printer 300 that is an image forming apparatus and includes the large capacity tray 400 according to an embodiment of the present invention are explained below with reference to FIG. 1. As shown in FIG. 1, the large capacity tray 400 includes a paper feeding device 100. The large capacity tray 400 is connected to a lateral side of an image forming apparatus body 200. The large capacity tray 400 is configured capable to load thereon a large volume of paper. According to the embodiment, paper is to be fed by using the paper feeding device 100 included in the large capacity tray 400, and to be conveyed to the image forming apparatus body 200. A not-shown image forming unit in the image forming apparatus body 200 then forms an image on the paper, and the paper is delivered from the image forming apparatus body 200. The paper feeding device 100 can also be provided within the image forming apparatus body 200 as well as arranged on the lateral side of the image forming apparatus body 200.

Figure 2A:
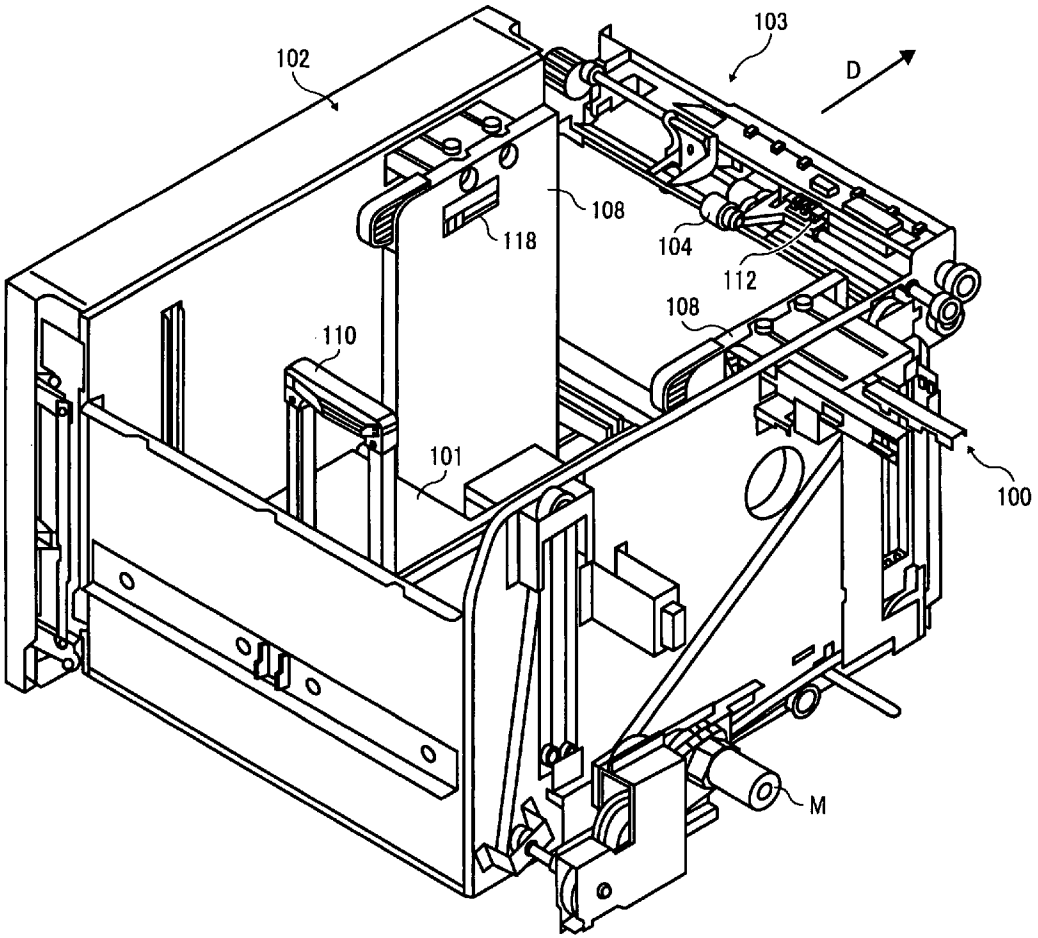
FIG. 2A is a perspective view of a configuration of a paper feeding device according to the embodiment of the present invention.

The paper feeding device 100 according to the embodiment is explained below with reference to FIG. 2A. As shown in FIG. 2A, the paper feeding device 100 includes a bottom plate 101 on which a plurality of sheets of paper is loaded. Moreover, the paper feeding device 100 includes a paper tray 102, and a paper feeding unit 103. The paper tray 102 is a paper storage unit that includes the bottom plate 101. The paper feeding unit 103 takes out a sheet of paper placed on the top of a bundle of paper sheet by sheet, and feeds the sheet to the image forming apparatus body 200 in the direction of an arrow D. The paper tray 102 includes a pair of side fences 108 arranged on both lateral sides inside the paper tray 102. The side fences 108 are width-direction regulating members that regulate the width of a bundle of sheets of paper loaded on the bottom plate 101 from lateral sides of the paper feeding direction. The paper tray 102 includes an end fence 110 that presses an edge side of paper at the upstream of the paper feeding direction of sheets of paper. Furthermore, the paper feeding device 100 includes a pair of air outlets 118 on the side fences 108 on the both sides.

Moreover, the paper tray 102 includes a photo interrupter sensor 112, which is a detecting unit that detects an upper limit of a feeding level of a bundle of paper. Furthermore, the paper tray 102 is configured to control a paper feeding level by moving the bottom plate 101 up and down with a lifting motor M in order to avoid an unsteady paper feeding level even when a remaining quantity of paper is little. Thus, to keep conditions for separating and feeding paper constant, the paper feeding device 100 is configured to control optimization of the upper limit position of paper to keep the paper feeding position constant regardless of increase or decrease in the volume of loaded paper.

In addition, the paper feeding device 100 is configured to be detachable from the large capacity tray 400. When loading sheets of paper into the paper feeding device 100, a user can detach the paper feeding device 100 from the large capacity tray 400 and load paper into the paper feeding device 100.

Figure 2B:
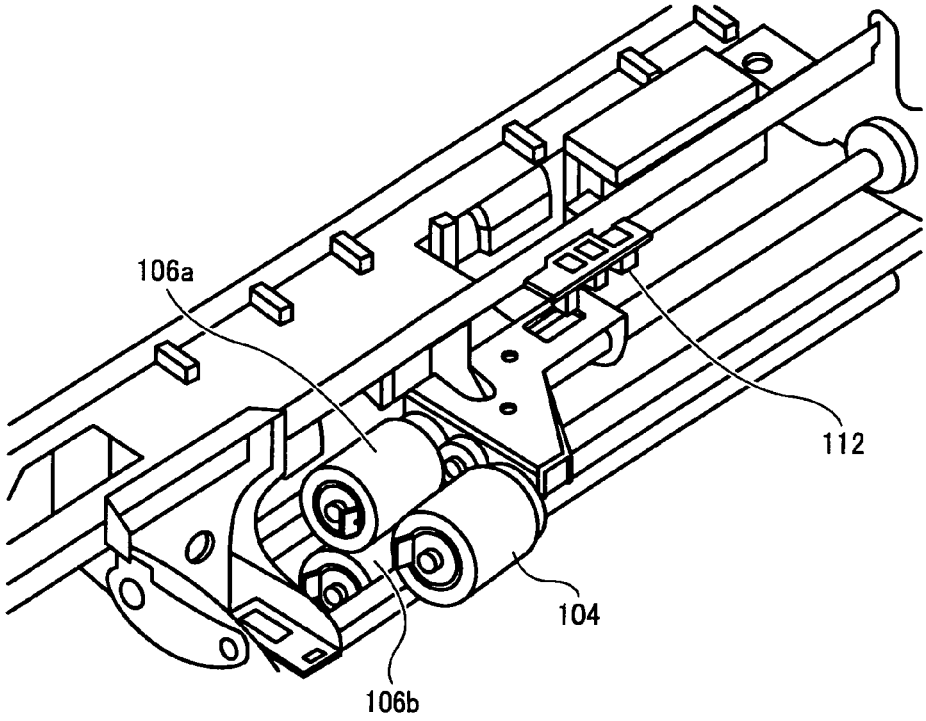
FIG. 2B is an enlarged perspective view of a paper feeding unit of the paper feeding device shown in FIG. 2A.

An enlarged perspective view of the paper feeding unit 103 is explained below with reference to FIG. 2B. The paper feeding unit 103 includes a paper feeding roller 104, a separating roller 106*a*, and a reverse roller 106*b*. The paper feeding unit 103 feeds paper by rotating and driving the paper feeding roller 104, the separating roller 106*a*, and the reverse roller 106*b* in accordance with respective predetermined feeding timings.

Figure 3:
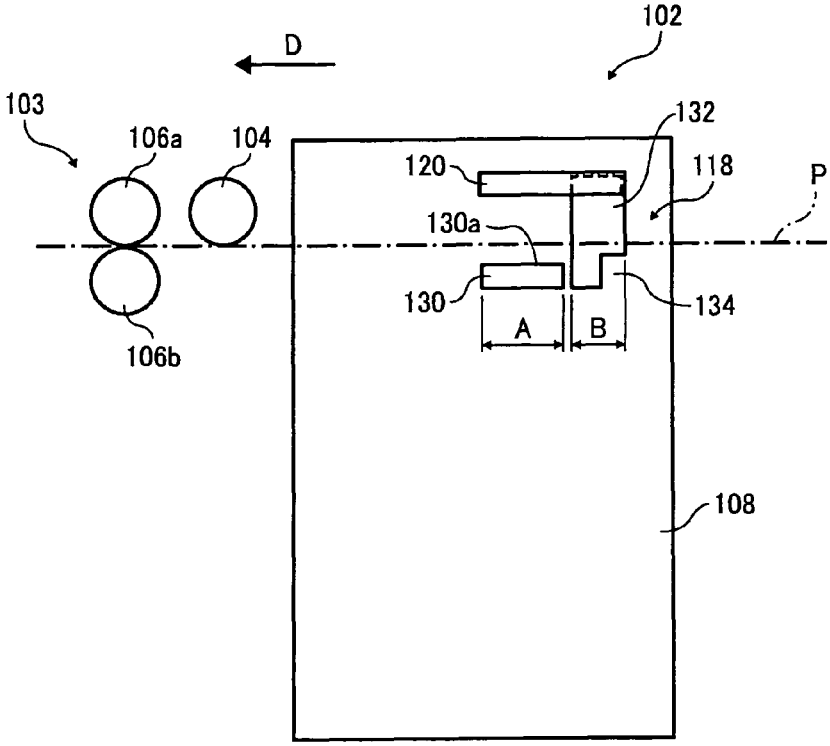
FIG. 3 is a schematic diagram for explaining a side fence included in a paper tray of the paper feeding device shown in FIG. 2A when looking at the side fence from a lateral side of a paper feeding direction.
Figure 4:
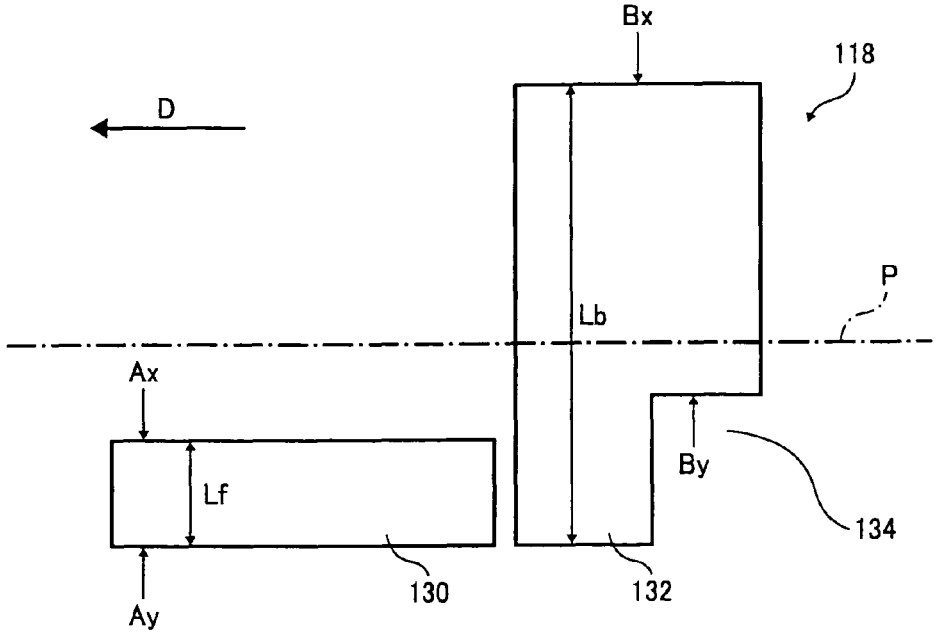
FIG. 4 is a schematic diagram for explaining a characteristic shape of an opening of an air outlet of the paper feeding device shown in FIG. 2A when looking at the air outlet from the lateral side of the paper feeding direction.

A schematic diagram of one of the side fences 108 provided on the paper tray 102 when looking at it from a lateral side of the paper feeding direction is explained below with reference to FIG. 3. As shown in FIG. 3, the paper tray 102 includes the air outlet 118 arranged in a vertically upper area of the side fence 108. A paper pressing plate 120 is provided vertically above the air outlet 118, and configured capable to move with a blown air. Moreover, the paper pressing plate 120 is formed to overlap with a part of the air outlet 118. The air outlet 118 is formed such that a part of the air outlet 118 vertically straddles a paper-feeding plane P. More details are shown in FIGS. 4 and 5.

As shown in FIG. 3, the air outlet 118 includes a first opening 130 and a second opening 132 that is arranged upstream from the first opening 130 in the paper feeding direction. The first opening 130 is formed to have a level of an upper edge 130*a* that is arranged at a lower level than the paper-feeding plane P on which the paper feeding unit 103 feeds paper, and to extend along the paper-feeding plane P. The second opening 132 is arranged upstream from the first opening 130 in the paper feeding direction, and formed to straddle the paper-feeding plane P vertically.

As shown in FIG. 3, a paper feeding-direction length A of the first opening 130 is formed to be longer than a paper feeding-direction length B of the second opening 132. The first opening 130 is formed such that the paper feeding-direction length is long, and a vertical width is relatively narrow. Accordingly, air can be inserted toward the center of paper, so that an effect of loosening the bundle of paper can be improved. The second opening 132 blows air to a top sheet of paper vertically above the paper-feeding plane P, thereby achieving a large volume of an air flow and maintaining floating of paper.

According to the embodiment, the first opening 130 loosens the bundle of paper, and the second opening 132 floats the paper. Accordingly, air reaches the center of paper, a distribution of an air pressure onto the paper is evened, so that air can be supplied between sheets of paper even when the paper is relatively large in size. As an obstruction 134 is formed, the volume of an air flow in the upstream of the paper feeding direction can be reduced, so that an effect of separating a top sheet of paper from the following sheets can be enhanced, and multiple-sheet feeding can be prevented. More details are shown in FIG. 5.

The air outlet 118 shown in FIG. 3 includes a plurality of openings in addition to the first opening 130 and the second opening 132, and if the openings form mesh, it is understood that the total of the openings forms the air outlet 118.

A characteristic shape of an opening of the air outlet 118 when looking at it from the lateral side of the paper feeding direction is explained below with reference to FIG. 4. As shown in FIG. 4, paper is fed in the direction of the arrow D. The air outlet 118 includes a portion that an upper edge Bx in the upstream of the paper feeding direction is vertically higher than an upper edge Ax in the downstream of the paper feeding direction. Accordingly, paper of which the bundle is loosened in the downstream of the paper feeding direction can be floated in the upstream of the paper feeding direction.

The air outlet 118 includes a portion that a lower edge By in the upstream of the paper feeding direction is vertically higher than a lower edge Ay in the downstream of the paper feeding direction. In other words, the obstruction 134 is formed on a part of the second opening 132. As the obstruction 134 is formed, the obstruction 134 restricts the volume of an air flow in the upstream of the paper feeding direction, thereby preventing paper from floating too high in the upstream of the paper feeding direction. As the obstruction 134 restricts the air flow to the second and the following sheets of paper under the top sheet in the upstream of the paper feeding direction, the top sheet of paper can be separated from the rest of the paper.

As shown in FIG. 4, an opening shape of the air outlet 118 is divided into the first opening 130 and the second opening 132. Accordingly, different volumes of air flows can be set for the first opening 130 and the second opening 132 individually. Alternatively, the first opening 130 and the second opening 132 can be integrated. In such case, the volume of an air flow blown from the air outlet 118 can be evened on the whole. Furthermore in the case where the openings are integrated, it is advantageous that openings do not need to be provided at a plurality of positions when arrangement of a not-shown air-blower fan is mechanically restricted.

As shown in FIG. 4, the air outlet 118 is formed such that the lower edge By in the upstream of the paper feeding direction is vertically lower than the paper-feeding plane P. Accordingly, paper in the upstream of the paper feeding direction can be floated, so that a sheet of paper can be angled to come easily into the paper feeding unit 103.

As shown in FIG. 4, the air outlet 118 is formed such that a distance Lf between the upper edge Ax and the lower edge Ay in the downstream of the paper feeding direction is shorter than a distance Lb between the upper edge Bx and the lower edge By in the upstream of the paper feeding direction. Accordingly, a larger volume of an air flow can be obtained in the upstream of the paper feeding direction, and paper is floated vertically higher in the upstream than in the downstream of the paper feeding direction, so that floating of the paper in the height direction of paper can be maintained in the upstream of the paper feeding direction.

Figure 5A:
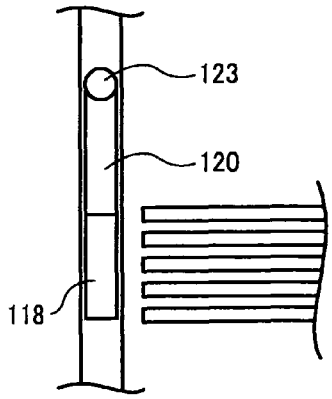
FIGS. 5A to 5C are schematic diagrams for explaining the air outlet, which is a characteristic part in the embodiment, when looking at the air outlet from the paper feeding direction.
Figure 5B:
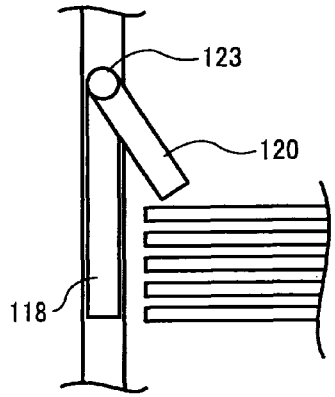

FIGS. 5A and 5B depict schematic diagrams of one of the air outlets 118, which is a characteristic part in the embodiment, when looking at it from the paper feeding direction. FIG. 5A depicts a case of not blowing air. FIG. 5B depicts a case of blowing air. According to the embodiment, each of the air outlets 118 includes the paper pressing plate 120, which is a paper pressing unit that presses a sheet of paper placed on the top of loaded paper. The paper pressing plate 120 is configured capable to move with a blown air around a movable shaft 123 to a side on which the paper is loaded. As shown in FIG. 5B, the paper pressing plate 120 is configured capable to move with a blown-air pressure to approximately 35 degrees from the side fence 108 when blowing air. The paper pressing plate 120 is configured so as to hang over the paper and to press a sheet of paper placed on the top of the paper from a vertically upper level with a lower end of the paper pressing plate 120 opposite to the movable shaft 123. Furthermore, the paper pressing plate 120 can suppress floating of paper by changing an air-flow direction in the back side of the paper pressing plate 120, and directing an air flow vertically downward.

Moreover, the paper pressing plate 120 is configured to block a region of a substantially upper-half of the opening of the air outlet 118. Accordingly, a region of a substantially lower-half of the air outlet 118 is not blocked, so that air is blown.

Figure 5C:
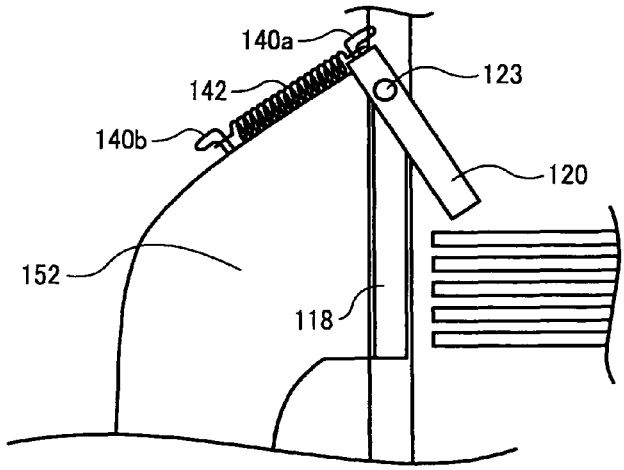

In addition to such configuration that the paper pressing plate 120 can move with a blown air from the air outlet 118, the paper pressing plate 120 can be otherwise configured, as shown in FIG. 5C, to turn around the movable shaft 123 with a spring, for example, and to be biased to the paper bundle side. For example, as shown in FIG. 5C, projections 140*a* and 140*b* are provided on an upper part of the paper pressing plate 120 and an upper part of an air duct 152, respectively, and an elastic member 142 is provided to bridge the projections. The elastic member 142 is a spring that has a tension in a contraction direction.

When the paper pressing plate 120 is configured capable to move with a blown-air, if start timing of lifting the bottom plate 101 is earlier than start timing of blowing air from the air outlet 118, there is a possibility that the paper pressing plate 120 is obstructed by a bundle of paper. Therefore, the start timing of blowing air from the air outlet 118 needs to be earlier than the start timing of lifting the bottom plate 101.

As shown in FIG. 5C, because the paper pressing plate 120 is configured to be biased to the paper bundle side by the elastic member 142, lifting of the bottom plate 101 can be started regardless of the start timing of blowing air from the air outlet 118.

Moreover, because the paper pressing plate 120 is coupled with the elastic member 142, if pressing the paper pressing plate 120 from the paper bundle side, the paper pressing plate 120 is turned around the movable shaft 123 and retracted toward the air outlet 118. Accordingly, when adding paper into the paper tray 102, the pair of the paper pressing plates 120 is pressed and widened by the paper, so that an operation of adding paper can be performed smoothly. After paper is loaded, as the elastic member 142 has a tension in the contraction direction, the paper pressing plate 120 can turn around the movable shaft 123, and can return to the state of being biased upward.

Figure 6A:
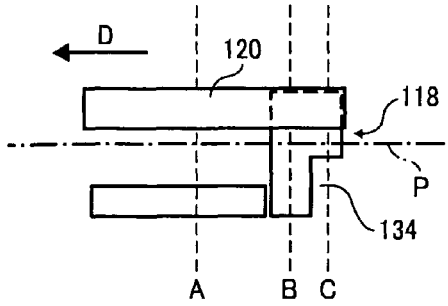
FIG. 6A is a schematic diagram for explaining a process of feeding paper when looking at the air outlet from the lateral side of the paper feeding direction.

A process of feeding paper when looking at the air outlet 118 from the lateral side of the paper feeding direction is explained below with reference to FIG. 6A. The paper pressing plate 120 is formed to extend along the arrow D indicating the paper feeding direction, to suppress floating of a top sheet of paper, and to cover a part of the air outlet 118, and changes an air-flow direction to the paper. In such case, air flows differently depending on a position of the air outlet 118 in the paper feeding direction. As shown in FIG. 6A, suppose a point A as a first part, a point B as a second part, and a point C as a third part are situated on the air outlet 118 along the paper feeding direction.

According to the embodiment, the paper pressing plate 120 is used as a unit that changes an air-flow direction. However, instead of using the paper pressing plate 120, an air-flow direction toward paper can be changed along the paper feeding direction of the air outlet 118 by combining the air outlet 118 and an arbitrary member appropriately. As an example of an air-flow direction changing unit that changes an air-flow direction, a fixed member can be provided on a part of the air outlet 118. For example, a plate member can be fixedly arranged on a part of the air outlet 118 along the paper feeding direction in a slanting manner from the side fence 108. In other words, the air-flow direction changing unit can be such plate member as long as the air outlet 118 changes an air-flow direction at the upstream and the downstream of the air outlet 118 in the paper feeding direction according to the configuration that the plate member arranged in a slanting manner. Furthermore, even if the air outlet 118 has a simple shape, a not-shown nozzle as an air-flow channel can be arranged vertically upward or downward along the paper feeding direction. In such case, an air-flow direction to paper can be changed at the upstream and the downstream of the paper feeding direction along the paper feeding direction of the air outlet 118 without changing the shape of the air outlet 118.

Moreover, according to the embodiment, the paper pressing plate 120 as the air-flow direction changing unit is configured movable. Accordingly, as the paper pressing plate 120 can be retracted to the side fence 108 when not blowing air, an effect is produced such that a user can load paper more smoothly, compared with a case where the paper pressing plate 120 is fixed.

A flow of air in the process of feeding paper when looking at the air outlet 118 from the paper feeding direction is explained below with respect to each of the points with reference to FIGS. 6B to 6D. Arrows in each of the figures indicate flows of air.

Figure 6B:
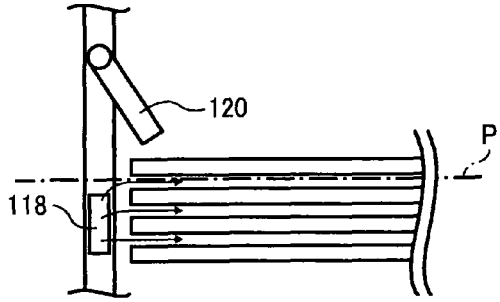
FIGS. 6B to 6D are schematic diagrams for explaining the process of feeding paper when looking at the air outlet from the paper feeding direction.

As shown in FIG. 6B, at the point A, the air outlet 118 is formed to open vertically below the paper-feeding plane P. Accordingly, when air is blown, as the air outlet 118 opens vertically below the paper-feeding plane P, the air is blown between sheets of paper, so that a bundle of the paper can be loosened. The paper pressing plate 120 presses paper from a vertically upper level. Accordingly, at the point A, an effect is obtained such that the paper is not floated too high by using the paper pressing plate 120, while the bundle of the paper is loosened with the opening of the air outlet 118. At the point A, a shape of the opening of the air outlet 118 is formed relatively elongate in the paper feeding direction compared with shapes at the point B and the point C. Accordingly, the bundle of paper can be loosened with a relatively strong air pressure at the point A. According to the embodiment, air can be blown to paper at least at three points, namely, the point A as the first part, the point B as the second part, and the point C as the third part, so that a tip of a sheet of paper near the paper feeding unit 103 can be kept in a constant state. Accordingly, the tip of the sheet of paper near the paper feeding unit 103 flaps little, the sheet of paper can be fed at an appropriate angle.

Figure 6C:
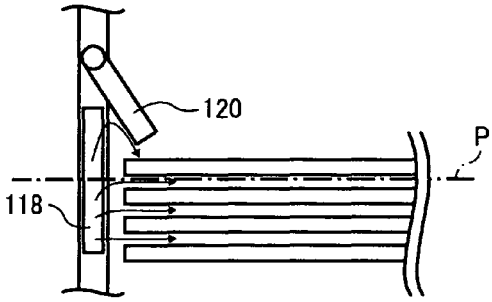

As shown in FIG. 6C, at the point B, the air outlet 118 is provided with the opening that is formed to straddle the paper-feeding plane P from a vertically lower area to a vertically upper area. Accordingly, when air is blown, similarly to the point A, the bundle of the paper can be loosened at first as the air is blown between sheets of the paper. As the opening is formed up to a level vertically above the paper-feeding plane P, an effect is obtained such that the paper is not lifted vertically too high because of the paper pressing plate 120 and the blown air that is changed in direction by the paper pressing plate 120, in addition to the flow of air at the point A.

Figure 6D:
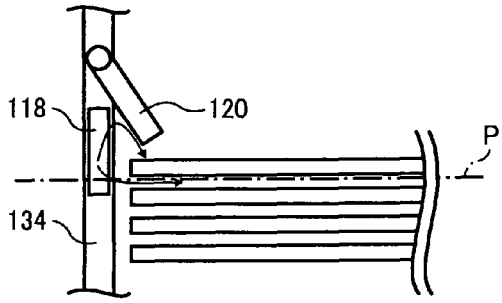

As shown in FIG. 6D, at the point C, the air outlet 118 is provided with the obstruction 134 that is formed vertically below the paper-feeding plane P. A flow of air vertically above the paper-feeding plane P is substantially the same as that at the point B. As the obstruction 134 is formed, the obstruction 134 reduces the volume of an air flow to be blown to the second and the following sheets of paper under the top sheet. Accordingly, at the point C, the level of floating of the second and the following sheets of paper can be suppressed. Furthermore, an air flow that is changed in direction by the paper pressing plate 120 is blown also from a vertically upper level to the top sheet. Accordingly, at the point C, while floating the top sheet of paper, the obstruction 134 prevents the second and the following sheets of paper under the top sheet from ascending too high. Particularly, when using paper of which surface is smoothed, such as coated paper, an excellent effect of separating a top sheet of paper from the rest of the sheets can be obtained, thereby preventing multiple-sheet feeding.

Figure 7:
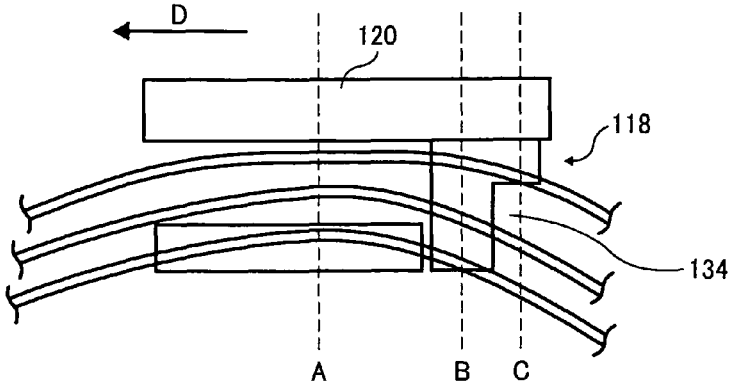
FIG. 7 is an enlarged schematic diagram of relevant parts of the paper feeding device when looking at a flow of air from the lateral side of the paper feeding direction.

An enlarged view of relevant parts when looking at the flows of air described above from the lateral side of the paper feeding direction is described below with reference to FIG. 7. The points A to C are similar to FIG. 6A. At the point A, a plurality of sheets of paper including a top sheet is separated, so that the sheets of paper are floated. At the point B, air is blown from a vertically upper level that is further above the floated top sheet of paper, so that the levels of the sheets of paper are lowered vertically downward from the levels at the point A. At the point C, the volume of an air flow blown to the sheets of paper following to the top sheet is restricted, and air is still blown from the upper level above the top sheet of paper, so that the sheets of paper are at levels vertically lower on the whole than the levels at the point B. According to the embodiment, because of the effects of the flows of air as described above, an appropriate angle to the paper feeding unit 103 are kept, so that each sheet of paper can be smoothly fed. A bundle of paper is loosened and sheets of paper are floated at the point A, ascending of the sheets of paper are suppressed at the point B, and separation of a top sheet of paper from the following sheets is enhanced at the point C, as a result, a curvature of the sheets of paper appropriate for feeding can be produced. According to the embodiment, as the points A to C are arranged in the vicinity of the air outlet 118 in a concentrated manner, air can be locally blown to a bundle of paper, so that change of an air-flow direction and separation can be performed regardless of a size of paper.

Other examples of shapes of openings of the air outlet 118 when looking at it, from the lateral side of the paper feeding direction are explained below with reference to FIGS. 8 to 18. The paper feeding direction is a direction indicated by the arrow D. The paper feeding device 100 according to the embodiment is configured to change an air-flow direction onto paper in the paper feeding direction at the air outlet 118 as the paper pressing plate 120 is provided on the air outlet 118 shown in one of FIGS. 8 to 18.

Figure 8:
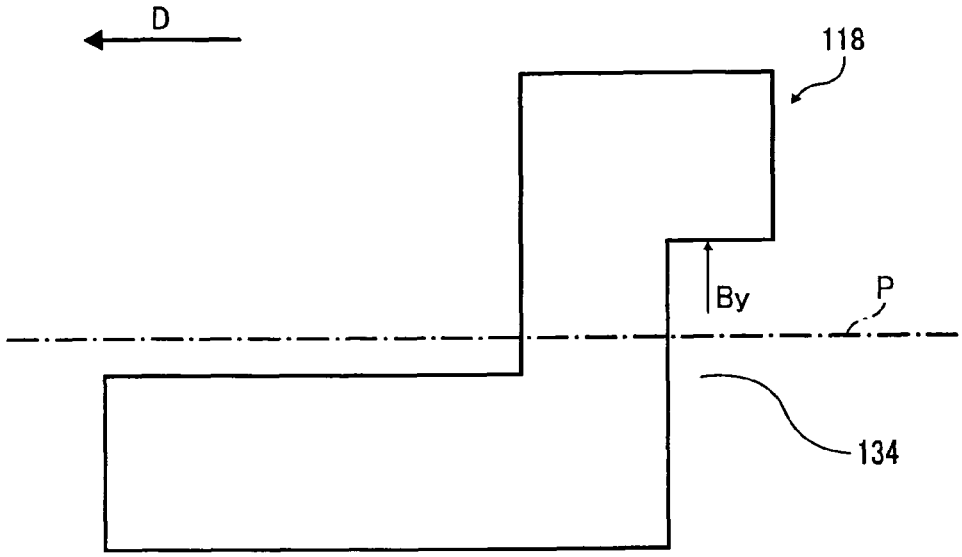
FIG. 8 is a schematic diagram of another example of a shape of an opening of the air outlet when looking at the air outlet from the lateral side of the paper feeding direction.

FIG. 8 depicts an example of the air outlet 118 of which the lower edge By in the upstream of the paper feeding direction is vertically above the paper-feeding plane P. According to the example, as an air flow from a vertically lower level relatively decreases in the upstream of the paper feeding direction, the air outlet 118 produces a little effect of maintaining floating of a top sheet of paper. However, as the obstruction 134 is formed relatively large compared with the example shown in FIG. 4, the second sheet of paper under the top sheet is vertically lowered to a larger extent, so that the air outlet 118 produces a strong effect of separating the top sheet of paper from the second sheet.

Figure 9:
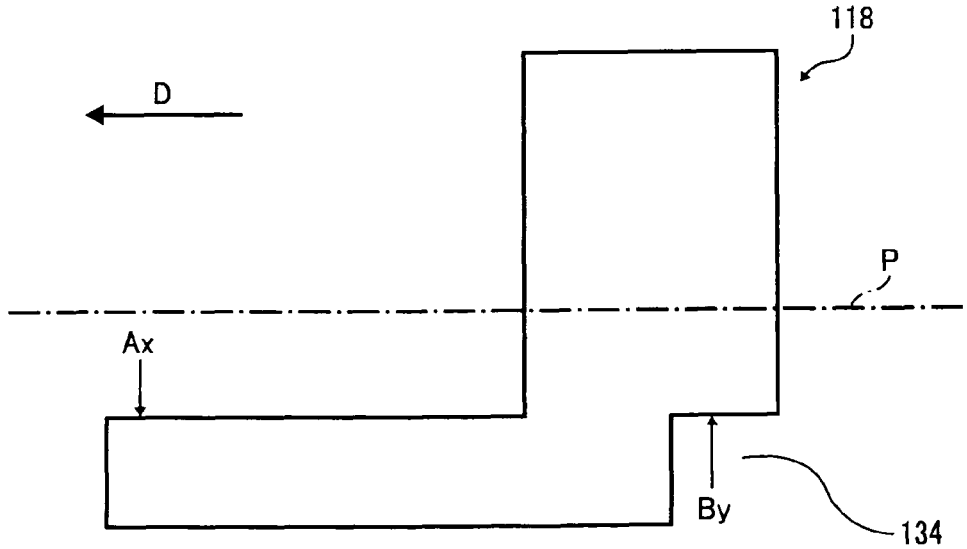
FIG. 9 is a schematic diagram of still another example of a shape of an opening of the air outlet when looking at the air outlet from the lateral side of the paper feeding direction.

FIG. 9 depicts another example of the air outlet 118 of which the lower edge By in the upstream of the paper feeding direction and the upper edge Ax in the downstream of the paper feeding direction are formed at the substantially same level. According to the example, as an air flow relatively increases in the upstream of the paper feeding direction compared with the example shown in FIG. 8, the air outlet 118 produces a strong effect of floating paper vertically upward.

Figure 10A:
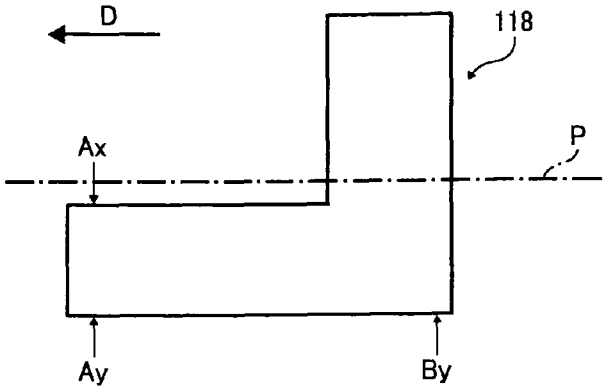
FIGS. 10A to 10C are schematic diagrams of still other examples of a shape of an opening of the air outlet when looking at the air outlet from the lateral side of the paper feeding direction.
Figure 10B:
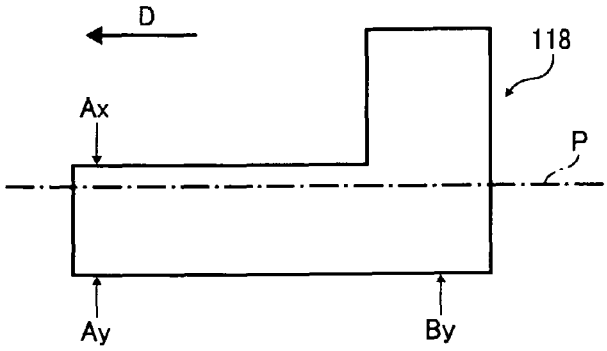
Figure 10C:
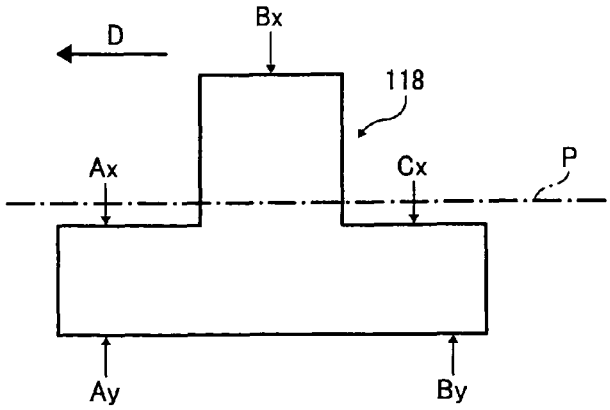

FIGS. 10A to 10C depict still other examples of the air outlet 118 of which the lower edge Ay in the downstream of the paper feeding direction and the lower edge By in the upstream of the paper feeding direction are formed at the substantially same level. As shown in FIG. 10A, the paper-feeding plane P is arranged above the upper edge Ax in the downstream of the paper feeding direction.

According to the example shown in FIG. 10A, compared with the example shown in FIG. 4, instead of the obstruction 134, a part of the opening is formed on a vertically lower level of the upstream of the paper feeding direction, and a larger volume of an air flow is obtained, consequently, the air outlet 118 produces a strong effect of floating the whole sheet of paper, although separation from the second and the following sheets of paper under the top sheet is less effective in the upstream of the paper feeding direction.

FIG. 10B depicts an example of the air outlet 118 of which the upper edge Ax in the downstream of the paper feeding direction is formed vertically higher than the paper-feeding plane P, compared with the example shown in FIG. 10A. According to the example, as the volumes of air flows from vertically upper and lower levels to paper in the downstream of the paper feeding direction are made larger, an angle of feeding a sheet of paper to the paper feeding unit 103 becomes larger, however, the air outlet 118 produces a strong effect of largely loosening the bundle of paper.

FIG. 10C depicts an example of the air outlet 118 of which an upper edge Cx in the upstream of the paper feeding direction is formed vertically lower than the upper edge Bx situated downstream from the upper edge Cx compared with the example shown in FIG. 10A, and the upper edge Ax in the downstream of the paper feeding direction is formed vertically lower than the upper edge Bx. According to the example, as a sheet of paper is floated in a substantially convex manner compared with the example shown in FIG. 10A, an angle of feeding a sheet of paper to the paper feeding unit 103 becomes large, however, a top sheet of paper can be lifted in a region of the upper edge Bx, so that the air outlet 118 produces a strong effect of maintaining floating of the top sheet of paper.

Figure 11:
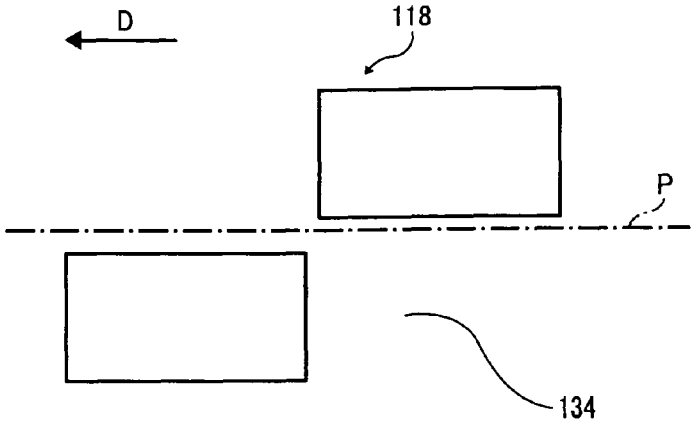
FIG. 11 is a schematic diagram of still another example of shapes of openings of the air outlet when looking at the air outlet from the lateral side of the paper feeding direction.

FIG. 11 depicts still another example of the air outlet 118 of which a plurality of openings is formed not to overlap in the horizontal direction. According to the embodiment, the air outlet 118 includes a portion having no opening, thereby producing a strong effect of preventing paper from ascending too high. Furthermore, as the obstruction 134 is formed in the upstream of the paper feeding direction, the air outlet 118 produces an excellent separation effect.

Figure 12:
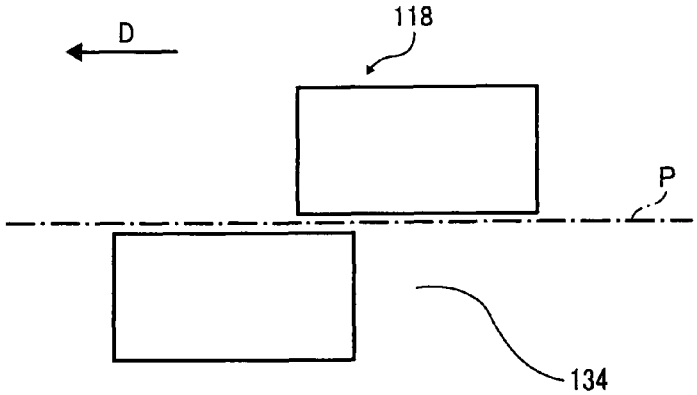
FIG. 12 is a schematic diagram of still another example of shapes of openings of the air outlet when looking at the air outlet from the lateral side of the paper feeding direction.

FIG. 12 depicts still another example of the air outlet 118 of which a part of an opening in the upstream of the paper feeding direction and a part of an opening in the downstream overlap in the horizontal direction. According to the example, as sheets of paper loosened from a bundle are floated in the downstream of the paper feeding direction, and the volume of an air flow to the paper is increased in the height direction at the overlapping part, compared with the example shown in FIG. 11, the air outlet 118 produces a strong effect of maintaining floating of the paper in the upstream of the paper feeding direction. Furthermore, as the obstruction 134 is formed in the upstream of the paper feeding direction, the air outlet 118 produces an excellent separation effect.

Figure 13:
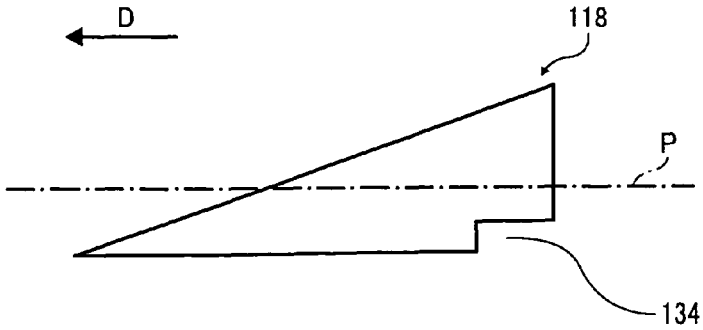
FIG. 13 is a schematic diagram of still another example of a shape of an opening of the air outlet when looking at the air outlet from the lateral side of the paper feeding direction.

FIG. 13 depicts still another example of the air outlet 118 of which upper edge slants downward from the upstream to the downstream in the paper feeding direction. According to the example, as the opening is formed into a slanting shape, the air outlet 118 produces a strong effect of making a gentler inclination of a sheet of paper being fed. Accordingly, an appropriate angle of approach of a sheet of paper into the paper feeding unit 103 can be obtained. Furthermore, as the obstruction 134 is formed, a top sheet of paper can be separated from the following sheets.

Figure 14:
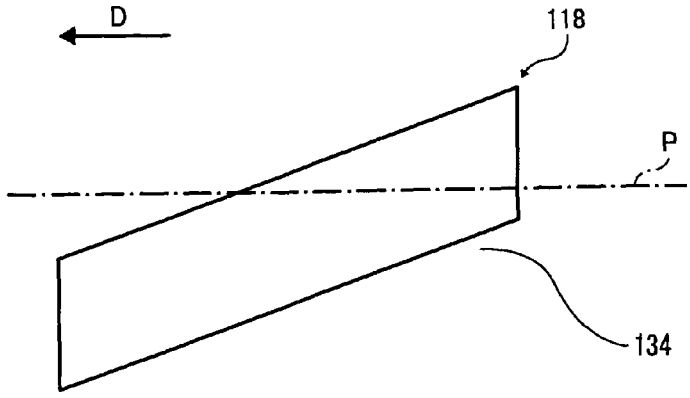
FIG. 14 is a schematic diagram of still another example of a shape of an opening of the air outlet when looking at the air outlet from the lateral side of the paper feeding direction.

FIG. 14 depicts still another example of the air outlet 118 of which upper edge and lower edge both slant downward from the upstream to the downstream in the paper feeding direction. According to the example, a part of the opening in the downstream of the paper feeding direction is formed large compared with FIG. 13. Accordingly, the air outlet 118 produces a strong effect of loosening the bundle of paper. Moreover, as the obstruction 134 is formed, a top sheet of paper can be separated from the following sheets. Furthermore, the air outlet 118 produces a strong effect of making a gentle inclination of paper along the inclinations of the upper edge and the lower edge to fit with angles of the upper edge and the lower edge. Accordingly, an appropriate angle of feeding paper to the paper feeding unit 103 can be obtained.

Figure 15:
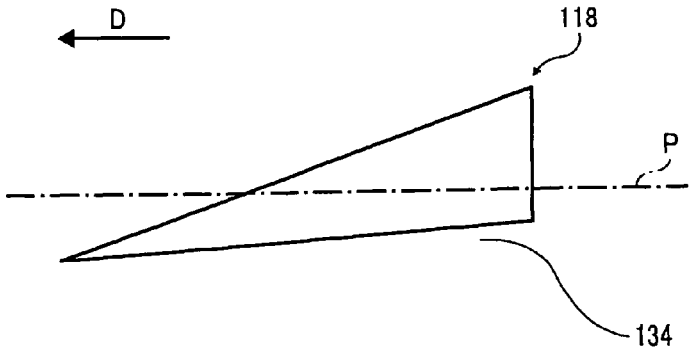
FIG. 15 is a schematic diagram of still another example of a shape of an opening of the air outlet when looking at the air outlet from the lateral side of the paper feeding direction.

FIG. 15 depicts still another example of the air outlet 118 of which both upper edge and lower edge slant. The air outlet 118 is formed such that its upper edge has a larger angle of inclination than its lower edge. According to the example, the air outlet 118 has the larger angle of inclination of the upper edge of the opening compared with the examples shown in FIGS. 13 and 14, thereby producing a strong effect of largely curving a sheet of paper. Accordingly, floating of paper in the upstream of the paper feeding direction can be maintained. As a portion of the opening in the downstream of the paper feeding direction is formed relatively small, loosening of the bundle of paper can be appropriately performed, and an appropriate angle of approach of a sheet of paper into the paper feeding unit 103 can be achieved. As the obstruction 134 is formed, a top sheet of paper can be separated from the following sheets of paper.

Figure 16:
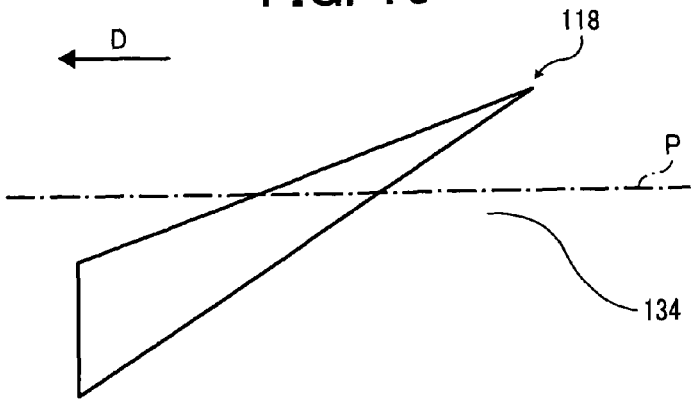
FIG. 16 is a schematic diagram of still another example of a shape of an opening of the air outlet when looking at the air outlet from the lateral side of the paper feeding direction.

FIG. 16 depicts still another example of the air outlet 118 of which lower edge has a larger angle of inclination than its upper edge. As a portion of the opening in the downstream of the paper feeding direction is larger than that in the upstream compared with the example shown in FIG. 15, the air outlet 118 produces a strong effect of loosening the bundle of paper. As the obstruction 134 is formed, a top sheet of paper can be separated from the following sheets of paper.

Figure 17:
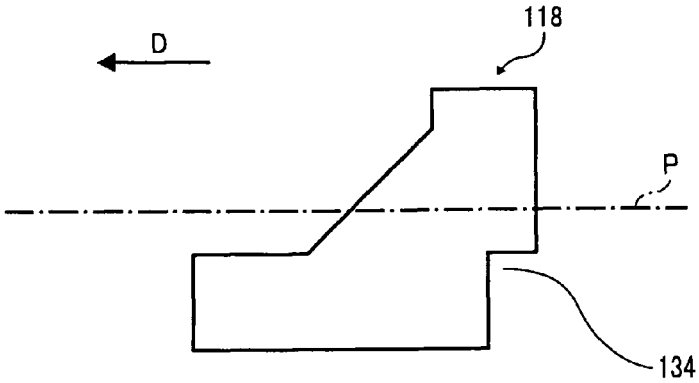
FIG. 17 is a schematic diagram of still another example of a shape of an opening of the air outlet when looking at the air outlet from the lateral side of the paper feeding direction.

FIG. 17 depicts still another example of the air outlet 118 that is substantially similar to the example shown in FIG. 4. According to the example, it is different from the example shown in FIG. 4 that the upper edge of the air outlet 118 includes an inclination part in addition to the example shown in FIG. 4. The air outlet 118 according to the example shown in FIG. 17 makes a gentler inclination of paper with the inclination part, and produces a strong effect of loosening the bundle of paper in the downstream of the paper feeding direction. Accordingly, an appropriate angle of feeding a sheet of paper can be achieved. As the obstruction 134 is formed, a top sheet of paper can be separated from the following sheets of paper.

Figure 18A:
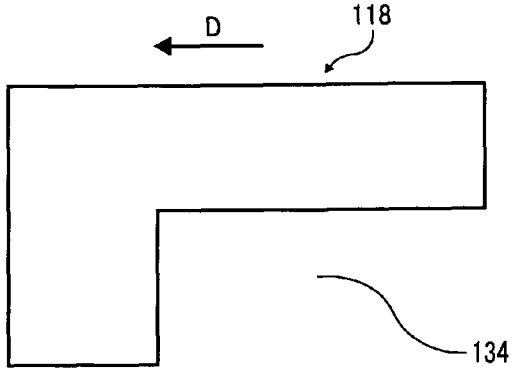
FIGS. 18A and 18B are schematic diagrams of still other examples of a shape of the opening of the air outlet when looking at the air outlet from the lateral side of the paper feeding direction.
Figure 18B:
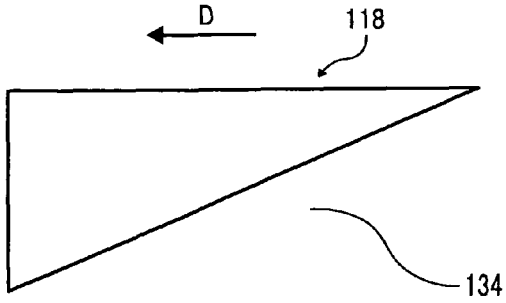

There are still other examples of the air outlet 118 as shown in FIGS. 18A and 18B. According to the example shown in FIG. 18A, the air outlet 118 is such that the upper edge in the upstream of the paper feeding direction and the upper edge in the downstream are at the substantially same level. Furthermore, a part of the opening is formed also on a vertically lower level in the downstream of the paper feeding direction. According to the example shown in FIG. 18B, the upper edge keeps the same level, while the lower edge slants downward from the upstream to the downstream. The lower edge in the upstream of the paper feeding direction is formed vertically higher than the lower edge in the downstream of the paper feeding direction. According to any one of the examples shown in FIGS. 18A and 18B, as the obstruction 134 is formed in the upstream of the paper feeding direction, the air outlet 118 produces an excellent separation effect.

According to the embodiment, the paper pressing plate 120 is used as a unit that changes an air-flow direction. However, instead of using the paper pressing plate 120, an air-flow direction toward paper can be changed along the paper feeding direction of the air outlet 118 by combining the air outlet 118 and an arbitrary member appropriately. As an example of an air-flow direction changing unit that changes an air-flow direction, a fixed member can be provided on a part of the air outlet 118. For example, a plate member can be fixedly arranged on a part of the air outlet 118 along the paper feeding direction in a slanting manner from the side fence 108. In other words, the air-flow direction changing unit can be such plate member as long as the air outlet 118 changes an air-flow direction at the upstream and the downstream of the air outlet 118 in the paper feeding direction according to the configuration that the plate member arranged in a slanting manner. Furthermore, even if the air outlet 118 has a simple shape, a not-shown nozzle as an air-flow channel can be arranged vertically upward or downward along the paper feeding direction. In such case, an air-flow direction to paper can be changed at the upstream and the downstream of the paper feeding direction along the paper feeding direction of the air outlet 118 without changing the shape of the air outlet 118. Moreover, according to the embodiment, the paper pressing plate 120 as the air-flow direction changing unit is configured movable. Accordingly, as the paper pressing plate 120 can be retracted to the side fence 108 when not blowing air, an effect is produced such that a user can load paper more smoothly, compared with a case where the paper pressing plate 120 is fixed.

Figure 19:
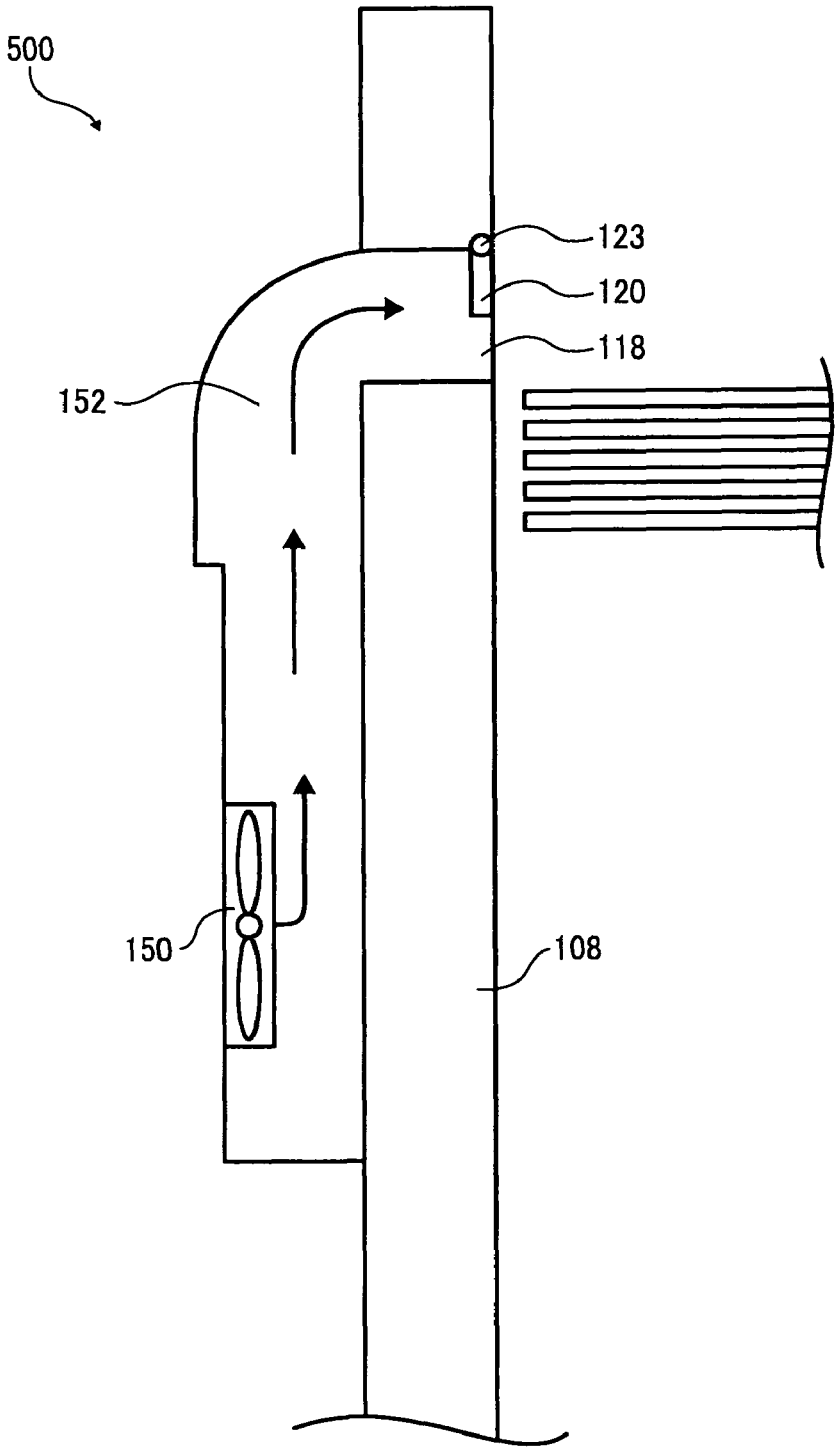
FIG. 19 is a cross-sectional schematic diagram of a blower configured to be included in the paper feeding device shown in FIG. 2A when looking at the blower from the paper feeding direction.

A cross section of an air blower 500 included in the paper feeding device 100 when looking at it from the paper feeding direction is explained below with reference to FIG. 19. The air blower 500 includes a blower fan 150, and the air duct 152, which is an air-flow guiding unit that guides an air flow generated by the blower fan 150. The blower fan 150 is provided outside each of the side fences 108. The paper pressing plate 120 that includes the movable shaft 123 on its end, and the air outlet 118 are formed on the air duct 152. According to the embodiment, the air outlet 118 is formed such that its cross-sectional area is smaller than the cross-sectional area of the air duct 152. Thus, as the air outlet 118 is formed to have a smaller cross-sectional area, an air pressure blown from the air outlet 118 can be increased under a constant volume of the air flow. Accordingly, paper can be floated more. According to the embodiment, the blower fan 150 generates an air flow from the ambient air. However, not limited to the ambient air, the blower fan 150 can employ any other configuration that can generate an air flow and can change a flow of air, by using a substitute.

Figure 20:
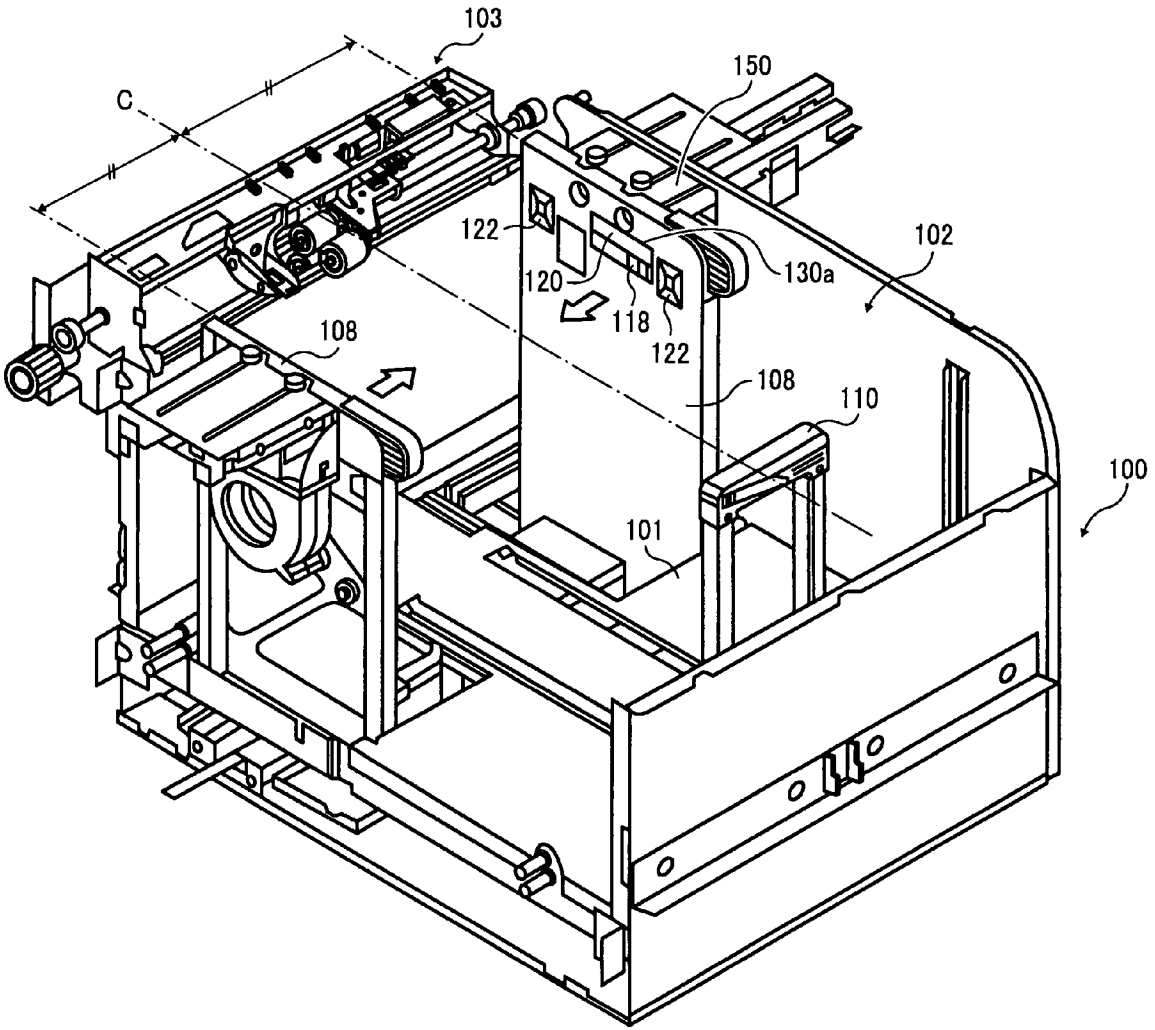
FIG. 20 is a perspective view of a configuration of the paper feeding device according to the embodiment.
Figure 21A:
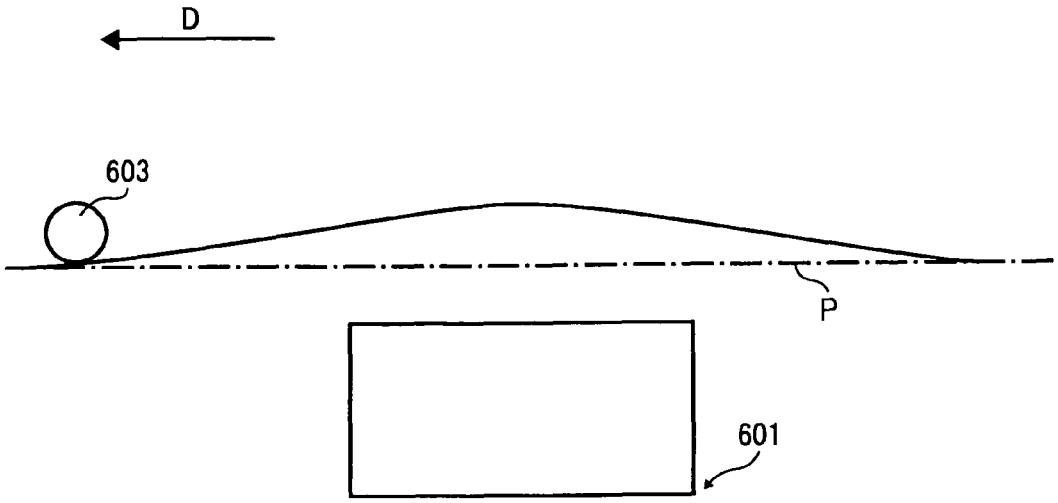
FIGS. 21A and 21B are schematic diagrams for explaining a conventional paper feeding device when looking at it from a lateral side of a paper feeding direction.
Figure 21B:
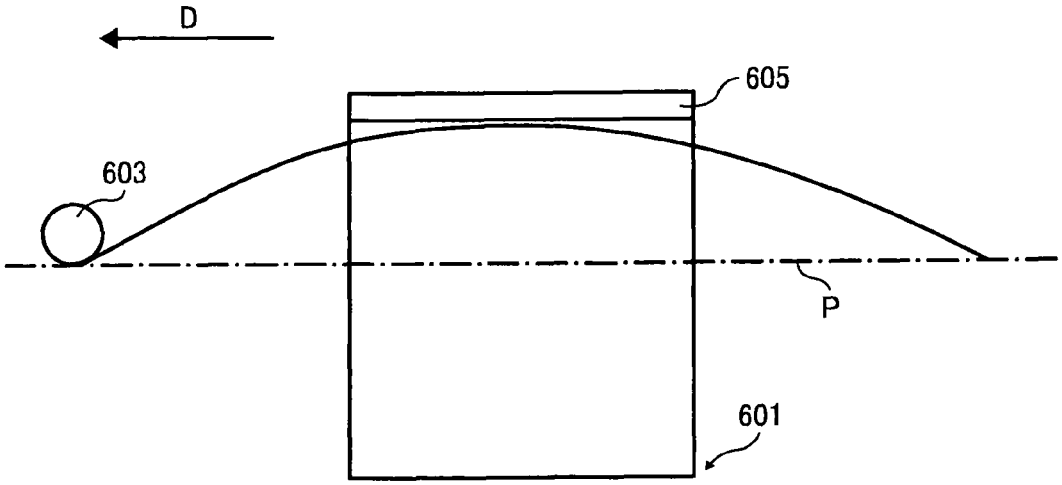

A perspective view of the paper feeding device 100 is explained below with reference to FIG. 20. FIG. 20 depicts the paper feeding device 100 on which a pair of the air outlets 118 in the same shape, for example, as one of the shapes shown in FIGS. 8 to 18, is symmetrically arranged on the pair of the side fences 108 that is arranged opposingly to each other. According to the embodiment, as the air outlets 118 are arranged symmetrically on the side fences 108, air is blown from even positions onto a center C of the paper-feeding width, accordingly, an even distribution of an air pressure blown from the air outlets 118 can be achieved, and loosening of the bundle of paper can be improved. Even if the size of paper is changed, the center C of the paper-feeding width is situated at the center between the side fences 108, so that air can uniformly penetrate between sheets of paper. Accordingly, the bundle of paper can be appropriately loosened. An air pressure inside the paper tray 102 is increased with the blown air. Flows of air comes out from the symmetrically arranged both sides, and collide near the center of paper, and the collided flows of air blow through upstream and downstream of the paper feeding direction. Because of the phenomenon, each sheet of paper generally floats up and separates from the other sheets. As air blows in the both direction, namely, the paper feeding direction and a direction orthogonal to the paper feeding direction, multiple-sheet feeding can be prevented. Because air blows through upstream and downstream of the paper feeding direction, any particular pressure reducing unit does not need to be provided.

The air duct 152 can make higher the speed of an outer flow to a corner of the air duct 152. Accordingly, a swing can be enhanced at the side of the movable shaft 123 of the paper pressing plate 120, as a result, an air-flow direction change can be encouraged.

If the air outlets 118 having openings different from each other in shape as shown in FIGS. 8 to 18 are symmetrically arranged on the side fences 108 that are opposingly arranged, different air flows are blown, so that an excellent effect of loosening of the bundle of paper can be obtained. Each of the side fences 108 is configured to move in an approaching direction and a departing direction with a not-shown interlock in synchronization with a pitch.

As shown in FIG. 20, paper pressing members 122 that press paper are each arranged upstream and downstream to each of the air outlets 118 in the paper feeding direction. The paper pressing members 122 press a bundle of paper from the lateral sides of the paper feeding direction. Moreover, the paper pressing members 122 are arranged to correct slanting of paper and to manage stable feeding of paper. To prevent flapping of a bundle of paper caused by the feeding, the paper pressing members 122 elastically press the both lateral-side surfaces of the paper width at a relatively vertically-upper portion of the bundle of paper. Conventionally, when blowing air to the lateral sides of a bundle of paper from the air outlets 118, clinging between sheets of the paper is reduced, consequently, the paper flaps between the side fences 108 due to the blowing of air, and vertically moves, resulting in a problem that stability of feeding is decreased. According to the embodiment, the paper pressing members 122 are arranged and prevent paper from flapping and ascending, so that paper can be stably fed. Each of the paper pressing members 122 is made from a plate spring. As another embodiment, a similar effect can be obtained by the paper pressing members 122 made by using Mayler (trademark), which is a polyester film, a sponge (expanded rubber), a stainless steel stick, or the like.

As described above, the printer 300 that includes the paper feeding device 100 explained in the embodiment can improve separation of coated paper, cardboard, and the like, which is difficult to be separated sheet by sheet. Thus, the printer 300 can reduce multiple-sheet feeding, can improve stability of a delivery quality as a device, and can improve an image quality.

According to the embodiment, plain paper is used as a recording medium. The embodiment of the present invention can provide a similar effect for coated paper, cardboard, overhead projector sheets, and the like, as well as the plain paper described above. In other words, the embodiment of the present invention is effective for a bundle of piled recording media between which clinging is particularly strong.

The embodiment is explained above by using an example of the paper feeding device 100 configured to supply paper to a photocopier or a printer. However, the present invention is not limited to this, but also can be generally applied to devices that supply paper or recording media, for example, a device that supplies paper as an original with an auto document feeder configured to be provided in an image reading device, and a device that supplies paper as inserting paper with an inserting-paper inserting device that inserts inserting paper, such as cardboard, color paper, paper with tab, or the like, between sheets on which images have been already formed.

According to an aspect of the present invention, the recording-medium feeding device configured to feed a recording medium separately sheet by sheet from loaded recording media includes an air outlet that blows air onto recording media from a lateral side of the recording-medium feeding direction. The air outlet is formed to straddle vertically the recording-medium feeding plane on which a recording medium is to be fed, and formed such that its upper edge situated upstream of the recording-medium feeding direction is to become vertically higher than its upper edge situated downstream of the recording-medium feeding direction. Accordingly, the recording-medium feeding device that can keep a sheet of paper floating when blowing air onto paper, and can keep an appropriate angle when feeding paper to the feeding unit, can be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A device for feeding a recording medium by separating loaded recording media sheet by sheet, the device comprising:

an air outlet that includes at least one opening blows air to the recording media from a lateral side with respect to a direction of feeding the recording-medium, the air outlet being formed cross a recording-medium feeding plane, wherein the air outlet is formed such that:

one of an upper most edge of the air outlet in an upstream direction of the recording-medium feeding direction is higher than an upper most edge of the air outlet in a downstream direction of the recording-medium feeding direction or a lower edge of the air outlet in the upstream most direction of the recording-medium feeding direction is higher than a lower edge of the air outlet in the downstream most direction of the recording-medium feeding direction, and the air outlet is further formed such that a center of the air outlet at an upstream most edge of the air outlet is higher than a center of the air outlet at a downstream most edge of the air outlet.

2. The device according to claim 1, wherein the air outlet is formed such that the lower edge of the air outlet in the upstream direction of the recording-medium feeding direction is lower than the recording-medium feeding plane.

3. The device according to claim 1, wherein the air outlet is formed such that a distance between the upper edge of the air outlet and the lower edge of the air outlet in the downstream direction of the recording-medium feeding direction is shorter than a distance between the upper edge of the air outlet and the lower edge of the air outlet in the upstream direction of the recording-medium feeding direction.

4. The device according to claim 1, wherein the air outlet is formed such that both the lower edge of the air outlet in the upstream direction of the recording-medium feeding direction is higher than the lower edge of the air outlet in the downstream direction of the recording-medium feeding direction, and the upper edge of the air outlet in the upstream direction of the recording-medium feeding direction is higher than the upper edge of the air outlet in the downstream direction of the recording-medium feeding direction.

5. The device according to claim 1, wherein the air outlet includes an inclination that the upper edge of the air outlet in the downstream direction of the recording-medium feeding direction is lower than the recording-medium feeding plane.

6. The device according to claim 1, wherein the air outlet includes a recording-medium pressing unit configured to move blown air to press an upper side of the recording medium.

7. The device according to claim 1, wherein the air outlet includes an inclination that slants downward from the upstream direction to the downstream direction in the recording-medium feeding direction on the upper edge of the air outlet.

8. The device according to claim 1, further comprising recording-medium pressing members that press the loaded recording media in the upstream direction and the downstream direction of the recording-medium feeding direction.

9. The device according to claim 1, wherein a pair of the air outlets are symmetrically arrange on a pair of side fences that are arranged opposite to each other for guiding a width direction of the loaded recording media by making a contact with lateral edges of the recording media.

10. The device according to claim 8, wherein the air outlet and the recording-medium pressing members are provided on side fences that are arranged opposite to each other for guiding a width direction of the loaded recording media by making a contact with lateral edges of the recording media.

11. The device according to claim 1, wherein the upper edge, the lower edge, the upstream edge, and the downstream edge are of one opening.

12. The device according to claim 6, wherein the recording-medium pressing unit is attached on the upper edge of the air outlet.

13. The device according to claim 6, wherein the recording-medium pressing unit is configured to block a region of a substantially upper-half of the opening of the air outlet.

* * * * *